US009115458B2

(12) United States Patent
Meydanli

(10) Patent No.: US 9,115,458 B2
(45) Date of Patent: Aug. 25, 2015

(54) WASHER/DRYER

(75) Inventor: Can Meydanli, Istanbul (TR)

(73) Assignee: Arcelik Anonim Sirketi, Istanbul (TR)

( * ) Notice: Subject to any disclaimer, the term of this patent is extended or adjusted under 35 U.S.C. 154(b) by 1188 days.

(21) Appl. No.: 12/594,252

(22) PCT Filed: Apr. 2, 2008

(86) PCT No.: PCT/EP2008/053905

§ 371 (c)(1),
(2), (4) Date: Oct. 1, 2009

(87) PCT Pub. No.: WO2008/119811

PCT Pub. Date: Oct. 9, 2008

(65) Prior Publication Data

US 2010/0116002 A1 May 13, 2010

(30) Foreign Application Priority Data

Apr. 2, 2007 (TR) ..... a 2007 02159

(51) Int. Cl.

| | |
|---|---|
| ***D06F 37/04*** | (2006.01) |
| ***D06F 37/06*** | (2006.01) |
| ***D06F 37/26*** | (2006.01) |

(52) U.S. Cl.

CPC ..... *D06F 37/04* (2013.01); *D06F 37/06* (2013.01); *D06F 37/264* (2013.01)

(58) Field of Classification Search

CPC ..... D06F 37/264; D06F 37/04; D06F 37/06
USPC ..... 68/20, 23 R, 24, 139, 140, 141, 142
See application file for complete search history.

(56) References Cited

U.S. PATENT DOCUMENTS

| | | | | |
|---|---|---|---|---|
| 2,173,603 | A * | 9/1939 | Dodge | 68/140 |
| 2,194,375 | A * | 3/1940 | Zimarik | 68/58 |
| 2,816,742 | A * | 12/1957 | Richterkessing et al. | 366/228 |
| 5,433,091 | A * | 7/1995 | Durazzani et al. | 68/140 |
| 5,802,886 | A * | 9/1998 | Kim | 68/142 |
| 5,862,687 | A * | 1/1999 | Jang | 68/142 |
| 6,279,357 | B1 * | 8/2001 | Didlick et al. | 68/20 |
| 7,762,109 | B2 * | 7/2010 | Garcia Bobed | 68/140 |
| 2005/0028568 | A1 * | 2/2005 | Koch et al. | 68/142 |
| 2005/0229651 | A1 * | 10/2005 | Ahn | 68/139 |
| 2005/0252252 | A1 * | 11/2005 | Lee et al. | 68/139 |

FOREIGN PATENT DOCUMENTS

| | | | |
|---|---|---|---|
| EP | 0810315 | A | 12/1997 |
| EP | 1693500 | A2 * | 8/2006 |
| GB | 1388731 | A | 3/1975 |

* cited by examiner

*Primary Examiner* — Joseph L Perrin
(74) *Attorney, Agent, or Firm* — Venjuris P.C.

(57) ABSTRACT

The present invention relates to washer/dryer (1) comprising a drum (3) having a high strength. The washer/dryer (1) of the present invention comprises a connector (9) that supports the drum (3) from the sides and distributes the forces acting on the flange (7) to the elements of the drum (3).

11 Claims, 2 Drawing Sheets

WASHER/DRYER

Figure 1:
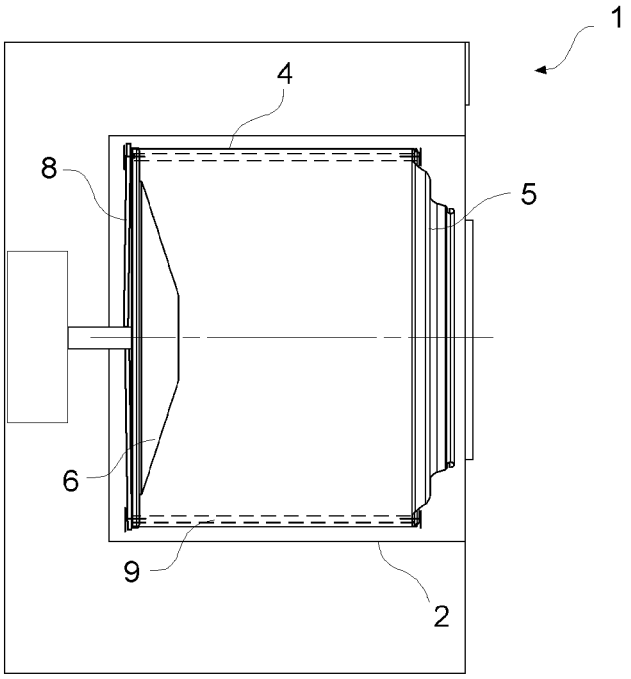

The present invention relates to a washer/dryer that comprises a drum, the strength of which is increased.

In washers/dryers the laundry to be washed and/or dried is placed inside a perforated drum. This drum is driven to rotate by a motor for maintaining the processes such as washing, drying, and spinning.

In particularly the horizontal axis washing machines, a great force is exerted on the wall of the drum due to high rotational speeds during the spinning and drying processes of unbalanced load as a result of the laundry piling up in a region of the drum. The drum is supported from the rear side thereof with a flange structure, to which the rotational movement is transmitted as well, so that it is not deformed with the effect of this force. The flange is fastened to the rear wall of the drum and this increases the load exerted on the rear wall. A certain gap is left between the tub and the drum so that the risk of the tub contacting the drum does not arise as a result of a deformation that may be formed on the rear wall and respectively the side walls. This leads to producing a drum having a smaller inner volume than is possible.

Various implementations have been developed in the technique for solving this problem. One of these implementations is explained in the European patent no EP1070779. In the said implementation, the flange is disposed on the rear wall of the basket and the flange spokes are connected to each other with a ring element to increase strength.

Another document known in the technique is the Great Britain patent application no GB1388731. In this document, the rear end wall of the drum is supported partially from the perimetral edge by the arms of the flange.

In another document in state of the art is the U.S. Pat. No. 5,433,091, while a plastic drum manufacturing method is explained a flange structure is described that supports the plastic up to half of the peripheral rim.

In these embodiments known in the technique, the flange is secured to the drum from one point besides being fastened to the center point on the rear wall. This position results in the force transmitted to the flange to create stress at the point the flange is connected to the drum.

The object of the present invention is to design a washer/dryer that comprises a drum having a high strength.

The washer/dryer designed to fulfill the objective of the present invention is explicated in the attached claims.

The flange used in the washer/dryer of the present invention comprises arms that are connected to each other from one end and to the center of the rear wall. The arms extend from the center to the sides and parallel to the rear wall surface when the flange is disposed on the rear wall.

The washer/dryer furthermore comprises at least one connector that extends parallel to the body for supporting the drum from the sides. The connector is secured from one end to the rear wall and to the free end of the arm at its level and to the front wall from the other end. In this way the force formed on the flange due to rotation of the drum is distributed to the front and rear wall. Therefore the stresses created by the rotational movement are counterbalanced not only by the flange and the rear wall but by also all the drum elements. The connectors provide the torque on the flange to be transmitted to the rear wall together with the front wall.

Fastening elements such as bolts, rivets etc. can be used for securing the connector to the front wall, rear wall and the arms. In an embodiment of the present invention, holes are formed on the surfaces whereon the connector will be secured for inserting the fastening elements.

In an embodiment of the present invention, the connectors are emplaced inside the ribs situated on the drum. Thus the connection is established without increasing the volume between the drum and the tub.

In the washer/dryer of the present invention, the connection of the flange is maintained with the drum body and the front wall as well as the rear wall for providing a more effective support. Thus, the deformation of the drum is reduced by enhancing the distribution of the load to the drum elements and hence keeping the required minimum distance therebetween the tub.

The washer/dryer designed to fulfill the objective of the present invention is illustrated in the attached figures, where:

FIG. 1—is the schematic view of a washer/dryer.

Figure 2:
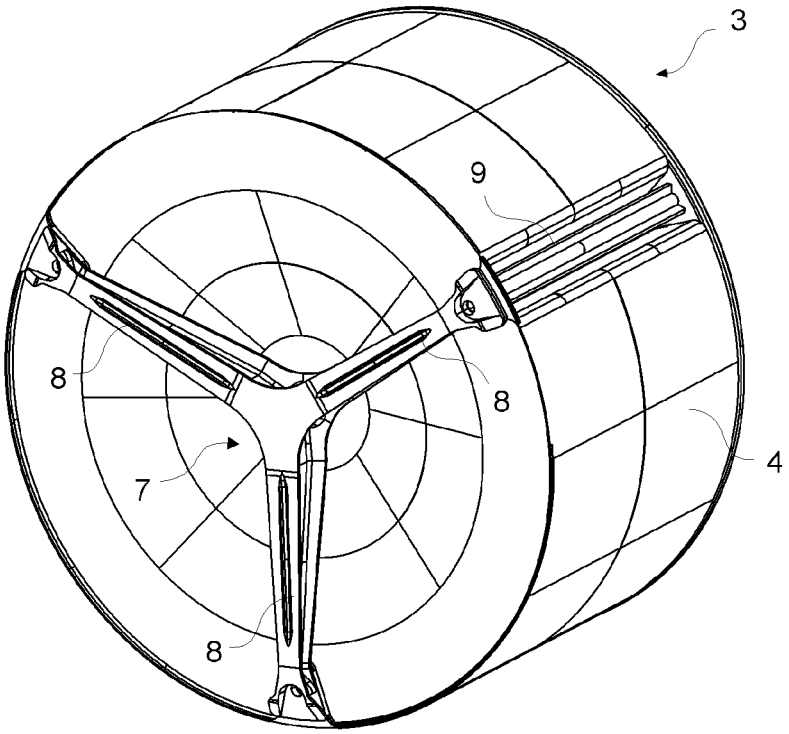

FIG. 2—is the rear perspective view of the drum with the flange and the connectors mounted thereon.

Figure 3:
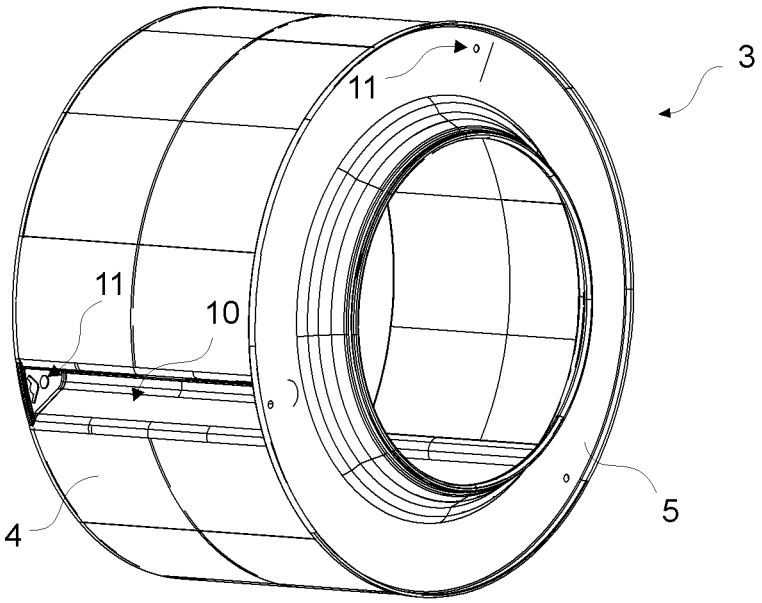

FIG. 3—is the front perspective view of the drum without the flange and the connectors mounted thereon.

Figure 4:
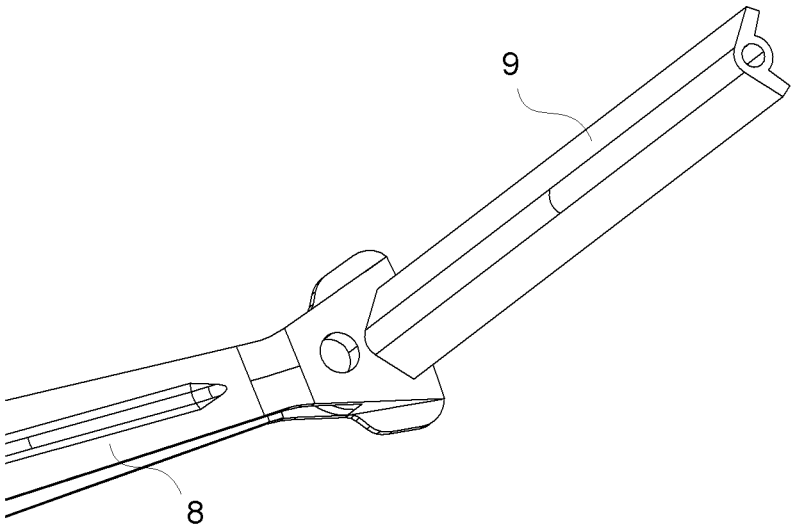

FIG. 4—is the detailed perspective view of the arm and the side support.

The elements illustrated in the figures are numbered as follows:

1. Washer/dryer
2. Tub
3. Drum
4. Body
5. Front wall
6. Rear wall
7. Flange
8. Arm
9. Connector
10. Rib
11. Hole The washer/dryer (1) of the present invention comprises a tub (2) and a drum (3) that is disposed inside this tub (2) (FIG. 1).

The drum (3) comprises
a cylindrical body (4),
a front wall (5) and a rear wall (6) mounted on the body (4) so as form the front and rear surfaces (FIG. 2).

The washer/dryer (1) comprises a flange (7) secured to the drum (3) rear wall (6) from the center for supporting the drum (3) against the forces imparted during rotation. The flange (7) comprises at least two arms (8) on the rear wall (6) to which it is secured, extending from the center to the sides, on the surface of the rear wall (6).

The washer/dryer (1) furthermore comprises connectors (9) for each arm (8), with one end secured to the free end of the arm (8) from the same point and to the rear wall (6), the other end to the front wall (5) and extending parallel to the body (4) between the rear wall (6) and the front wall (5). The load acting on the flange (7) during the rotation of the connector (9) and the drum (3) is distributed effectively to the front wall (5) and the rear wall (6).

In the preferred embodiment of the present invention, holes (11) are formed on the front and rear walls (5, 6) to insert through the fastening elements for securing the connectors (9) to the front wall (5), the rear wall (6) and the arms (8). Fastening elements such as bolts, rivets etc. can be used for fastening (FIG. 3).

In an embodiment of the present invention, the rear wall (6) remains between the connector (9) and the arm (8) at the point where the connector (9) is secured to the arm (8).

In another embodiment of the present invention, the connector (9) is secured to the arm (8) to be inserted through a housing situated on the rear wall (6) into the drum (3) and the arm (8) is secured to the rear wall (6) from another nearby point.

In an embodiment of the present invention, the drum (3) comprises ribs (10) configured by cambering inwards the cylindrical body (4). In this embodiment of the present invention, the connectors (9) are disposed inside the ribs (10). Thus, a zone that is otherwise dead is put to use.

In the preferred embodiment of the present invention, the flange (7) comprises at least three arms (8) disposed at equal intervals from the center outwards such that a star like shape is formed and three connectors (9) fastened thereto. Thus the drum (3) is supported symmetrically from all the directions during rotation.

In the preferred version of this embodiment, the washer/dryer (1) comprises an equal number of connectors (9) as that of the arms (8) and a rib (10) into which each connector (9) is emplaced.

In an embodiment of the present invention, the cross-section of the ribs (10) and the connectors (9) emplaced therein is virtually V shaped. Thus the flexural strength of the body (4) along the axis of the drum (3) is effectively increased.

By means of the washer/dryer (1) of the present invention, a washer/dryer (1) is designed wherein the load distribution is shared by the front and rear walls (5, 6), having a higher strength and accordingly the volume of the drum (3) is increased by leaving a shorter distance therebetween the tub (2).

The invention claimed is:

1. A washer/dryer (1), that comprises:

a tub (2), and a drum (3) having a cylindrical body (4) disposed inside the tub (2), wherein the cylindrical body forms sides of the drum, a front wall (5) and a rear wall (6) mounted on the body (4), wherein the rear wall includes:

a center, so as form a front surface and rear surface, a flange (7) secured to the drum (3) rear wall (6) from a center, that supports the drum (3) against the forces imparted during rotation and having at least two arms (8) that extend from the center to the sides, parallel to the surface of the rear wall (6) to a free end, and at least one connector (9) for each arm (8), with one end secured to the free end of the arm (8) and to the rear wall (6) from the same point, and the other end to the front wall (5) and extending parallel to the body (4) between the rear wall (6) and the front wall (5), wherein the drum further comprises ribs (10) that have a V shaped cross-section and wherein the at least one connector (9) for each rib has a V shaped cross-section matching that of the ribs (10) along an axis of the drum extending from the rear wall to the front wall.

2. The washer/dryer (1), as in claim 1, wherein the drum (3) further comprises the ribs (10) configured by cambering the body (4) inwards and having the at least one connector (9) disposed within these ribs (10).

3. The washer/dryer (1), as in claim 2, wherein the flange (7) comprises at least three arms (8) secured at a point near the center of the rear wall (6), and disposed equidistantly from the said point outwards such that a star like shape is formed.

4. The washer/dryer (1) as in claim 2, wherein the at least one connectors (9) has an equal number as that of the arms (8).

5. The washer/dryer (1), as in, claim 1, wherein the flange (7) comprises at least three arms (8) secured at a point near the center of the rear wall (6), and disposed equidistantly from the said point outwards such that a star like shape is formed.

6. The washer/dryer (1) as in claim 5, wherein the at least one connector (9) for each arm (8) is one connector (9).

7. The washer/dryer (1) as in, claim 1, wherein the at least one connector (9) for each arm (8) is one connector (9).

8. A washer/dryer (1), that comprises:

a tub (2), and a drum (3) having a cylindrical body (4) disposed inside the tub (2), wherein the cylindrical body forms sides of the drum, a front wall (5) and a rear wall (6) mounted on the body (4), wherein the rear wall includes:

a center so as form a front surface and rear surface, a flange (7) including at least two arms extending parallel to the rear wall from the center to the sides when the flange is disposed on the real wall, secured to the drum (3) rear wall (6) from the center, that supports the drum (3) against the forces imparted during rotation, and at least one connector (9) for each arm (8), with one end secured to the free end of the arm (8) and to the rear wall (6) from the same point, and the other end to the front wall (5) and extending parallel to the body (4) between the rear wall (6) and the front wall (5), wherein the drum further comprises ribs (10) that have a V shaped cross-section and wherein the at least one connector (9) for each rib has a V shaped cross-section matching that of the ribs (10) along an axis of the drum extending from the rear wall to the front wall.

9. The washer/dryer (1), as in claim 8, wherein the drum (3) further comprises the ribs (10) configured by cambering the body (4) inwards and having the at least one connector (9) disposed within these ribs (10).

10. The washer/dryer (1), as in, claim 9, wherein the flange (7) comprises at least three arms (8) secured at a point near the center of the rear wall (6), and disposed equidistantly from the said point outwards such that a star like shape is formed.

11. The washer/dryer (1) as in, claim 10, wherein the at least one connector (9) for each arm (8) is one connector (9).

* * * * *